US011053094B2

(12) United States Patent
Brunetti

(10) Patent No.: US 11,053,094 B2
(45) Date of Patent: Jul. 6, 2021

(54) FOLDING APPARATUS AND CORRESPONDING METHOD

(71) Applicant: I.M.A. INDUSTRIA MACCHINE AUTOMATICHE S.P.A., Ozzano dell'Emilia (IT)

(72) Inventor: Gabriele Brunetti, Ozzano Dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 230 days.

(21) Appl. No.: 15/770,409

(22) PCT Filed: Oct. 21, 2016

(86) PCT No.: PCT/EP2016/075473

§ 371 (c)(1),
(2) Date: Apr. 23, 2018

(87) PCT Pub. No.: WO2017/068168

PCT Pub. Date: Apr. 27, 2017

(65) Prior Publication Data

US 2018/0312366 A1 Nov. 1, 2018

(30) Foreign Application Priority Data

Oct. 23, 2015 (IT) ..... 102015000064996

(51) Int. Cl.
*B65H 45/12* (2006.01)
*B65H 19/22* (2006.01)
(Continued)

(52) U.S. Cl.
CPC ..... *B65H 45/12* (2013.01); *B42D 15/008* (2013.01); *B42D 15/042* (2013.01); *B65B 63/04* (2013.01);
(Continued)

(58) Field of Classification Search
CPC ..... B42D 15/042; B65H 29/008; B65H 19/2292; B65H 2301/418523;
(Continued)

(56) References Cited

U.S. PATENT DOCUMENTS 1,138,185 A * 5/1915 Boyce ..... B65H 45/12 493/435
4,179,111 A * 12/1979 Gunther, Jr. ..... B65H 45/12 493/216
(Continued)

FOREIGN PATENT DOCUMENTS

EP 2058257 A1 * 5/2009 ..... B42C 3/00

OTHER PUBLICATIONS

International Search Report and Written Opinion for PCT/EP2016/075473, dated Jan. 23, 2017.

*Primary Examiner* — Hemant Desai
*Assistant Examiner* — Christopher Robin Kim
(74) *Attorney, Agent, or Firm* — Marshall, Gerstein & Borun LLP

(57) ABSTRACT

An apparatus for folding sheets and corresponding method, including at least a conditioning body, at least a folding unit and at least an extraction mean suitable to fold sheets in
(Continued)

sequence of variable formats, maintaining high cadences and at the same time simplifying the structure for the maintenance operations and/or format-changes.

21 Claims, 4 Drawing Sheets

(51) Int. Cl.

| | |
|---|---|
| ***B65H 29/00*** | (2006.01) |
| ***B65H 75/28*** | (2006.01) |
| ***B65B 63/04*** | (2006.01) |
| ***B42D 15/00*** | (2006.01) |
| ***B42D 15/04*** | (2006.01) |
| *B65B 61/20* | (2006.01) |

(52) U.S. Cl.
CPC ..... *B65H 19/2292* (2013.01); *B65H 29/008* (2013.01); *B65H 75/28* (2013.01); *B65B 61/20* (2013.01); *B65H 2301/418523* (2013.01); *B65H 2403/20* (2013.01); *B65H 2701/18486* (2013.01)

(58) Field of Classification Search
CPC .. B65H 45/12; B65H 45/101; B65H 45/1015; B65H 45/20; B65H 45/228; B65H 37/06
USPC ..... 493/407
See application file for complete search history.

(56) References Cited

U.S. PATENT DOCUMENTS

| | | | | | |
|---|---|---|---|---|---|
| 4,248,414 | A * | 2/1981 | Rovin | B65H 45/04 | 493/416 |
| 4,403,981 | A * | 9/1983 | Wuthrich | B65H 29/008 | 493/249 |
| 4,875,668 | A * | 10/1989 | Spyra | B42C 3/00 | 270/45 |
| 5,259,827 | A * | 11/1993 | Staniszewski | B65H 45/12 | 493/23 |
| 5,261,985 | A * | 11/1993 | Lin | B65H 45/12 | 156/218 |
| 5,876,320 | A * | 3/1999 | LeCompte | B65H 45/12 | 493/125 |
| 6,042,529 | A * | 3/2000 | Hubler | B43M 3/04 | 493/434 |
| 2004/0217535 | A1* | 11/2004 | Villanueva | B42C 19/02 | 270/52.17 |
| 2011/0065561 | A1* | 3/2011 | Cooper | B42C 3/00 | 493/407 |
| 2012/0275838 | A1* | 11/2012 | Imazu | B65H 45/12 | 400/578 |

* cited by examiner

FOLDING APPARATUS AND CORRESPONDING METHOD

FIELD OF THE INVENTION

The present invention concerns a folding apparatus and the corresponding method. In particular the folding apparatus is suitable to predispose instruction sheets and/or advertising sheets already folded, to be attached to packages of medicines and/or to various products, such as for example beauty products, food products or other types.

BACKGROUND OF THE INVENTION

Folding apparatuses are known, which have one or more folding seatings which allow to make the folds, that is, by folding the sheet sequentially in the folding seatings to obtain Z-shaped or double Z-shaped folded sheets, or similar shapes.

It is known that these folding apparatuses are not only bulky, but also very complex. In other words, known folding apparatuses are slow, require careful and precise regulation and need frequent maintenance.

Furthermore, known apparatuses require excess energy per sheet folded in each unit of time, they are expensive to construct and expensive to use.

The document EP 2.058.257 describes an apparatus for producing a leaflet, and a corresponding method, which use a mandrel to winding a sheet with a gripping finger provided inside the mandrel. This solution is particularly inadequate when the sheets to be folded have different dimensions, because in such cases blockages and/or damages might occur.

There is therefore a need to perfect the state of the art and make available a folding apparatus and corresponding method which overcome at least one of the disadvantages of the state of the art.

In particular, the purpose of the present invention is to be practical, quick in production, simple in construction, repairs and maintenance, and which is able to fold a considerable number of sheets in the unit of time.

Another purpose of the present invention is that it should use little power per sheet folded in the unit of time, that it should be inexpensive and allow rapid fitting of the format-change and simplified maintenance.

Another purpose of the present invention is to obtain a folding apparatus and corresponding method that allow to obtain efficient production cadences, coordinated with the cadences at least of the possible envelope machines located downstream.

It comes within the spirit of the invention that the folding apparatus can be associated with an apparatus to select and introduce the sheets, to create a single and coordinated complex.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus to fold sheets, and corresponding method, comprises at least a conditioning unit suitable to prepare the sheet for folding, at least an extraction mean able to move the sheet prepared for folding into the conditioning unit and at least a folding unit able to fold the sheet previously prepared.

According to a characteristic of the present invention, the conditioning unit has at least a containing body coordinated with a housing guide cooperating with at least a limitation body, said guide and said limitation body being suitable to position the sheet longitudinally in order to be able to work various formats.

According to another characteristic of the present invention, the conditioning unit comprises at least a cantilevered winding shaft and at least a containing body, both being able to be positioned and replaced, depending on the format of the sheet and on the desired folding pattern, individually and orthogonally to the work direction.

According to a variant, the winding shaft is inside a suitable specialized conditioning seating, located orthogonal to the introduction of the sheet, present in the containing body.

Moreover, the conditioning unit is coordinated at least to the folding unit and/or to the other work unit, for example, to introduce the sheets so as to be able to deliver them in a controlled manner to the folding unit.

According to a variant, the containing body has at least a longitudinal slit that embodies an entrance and an exit.

The longitudinal slit cooperates with means that guide the feed of the sheet, and with the housing guide for the correct positioning of the sheet.

According to a characteristic of the present invention, the winding shaft is rotatable around its longitudinal axis located at least orthogonally to the introduction of the sheet.

According to another variant, the longitudinal slit comprises a feeding slit present in the containing body and at least a winding slit that affects the cantilevered part of the shaft.

The slits present in the winding shaft and in the containing body are coordinated and in operating continuity.

These characteristics are connected and dependent on the need to be able to correctly position the sheet in the desired position, predisposing it in the shape of a tubular element in order to fold and extract the tubular element to supply it to the final folding unit.

According to a variant, the winding shaft is always positioned in the desired position, both in the positioning step of the conditioning body, and when this needs to be replaced, and also at the end of each winding cycle.

At the end of the winding cycle, an extraction mean intervenes, which moves the tubular element toward the folding unit.

According to a variant, the containing body can be replaced, with or without the attached winding shaft in relation to the desired format of the fold.

A variant provides that the extraction mean cooperates with a longitudinal seating present in the winding shaft, in order to simplify and guarantee a correct extraction of the tubular element.

According to a variant, the equivalent diameter of the winding shaft and/or the seating of the containing body can be modified, in order to modify the characteristics of the tubular element.

According to a variant, the modifications to the height of the slit present in the shaft and/or the containing body can be stable for a desired number of cycles, or so as to intervene only in the introduction step of the sheet.

According to another characteristic of the present invention, the method comprises:

- a step of positioning the folding apparatus, at least during the start-of-work step, and the possible positioning of its components;
- a step of introducing the sheet into the conditioning unit until the limitation body is reached;
- a step of winding the sheet onto the winding shaft to create a tubular element inside the containing body;
- a step of extracting the tubular element by an extractor element from the winding shaft;
- a step of inserting the tubular element into the folding unit;
- a step of compressing the tubular element to obtain the folded sheet.

It comes within the spirit of the invention that the introduction of the sheet as far as the limitation body present in cooperation with the housing guide provides that a section of sheet remains outside the entrance at least of the winding shaft.

It comes within the spirit of the invention to provide a return step of the extractor element.

It also comes within the spirit of the invention that the method has an operating speed of up to 350 single folded sheets per minute, advantageously but not exclusively a normal speed of around 250 single sheets per minute.

According to another variant of the present invention all the operations are totally automated.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
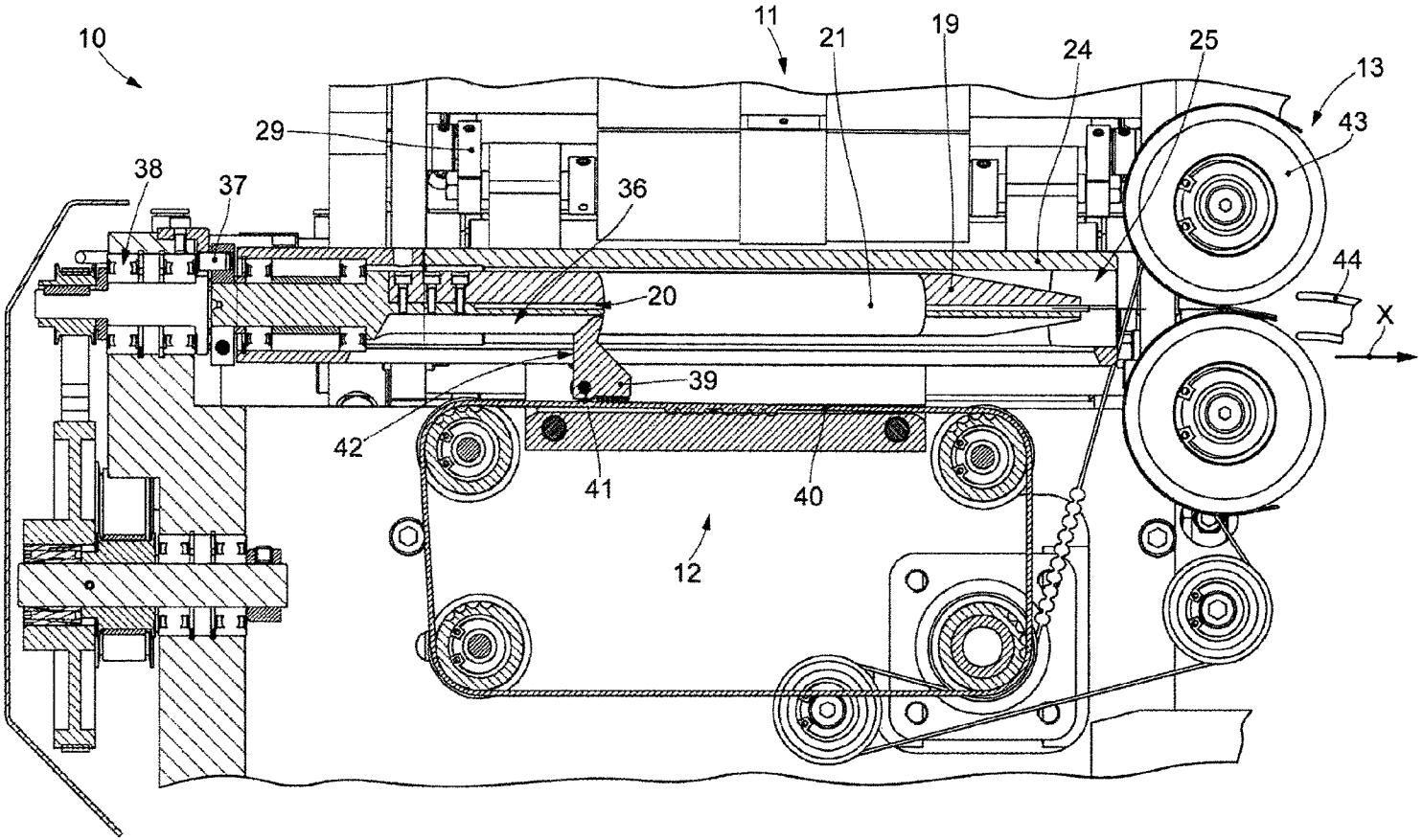
FIG. 1 is a cross-section respect to axis Y of FIG. 2 of a folding apparatus according to the present invention.

With reference to FIG. 1, a folding apparatus 10 according to the present invention comprises at least a conditioning unit 11, at least an extraction mean 12 and at least a folding unit 13.

Figure 2:
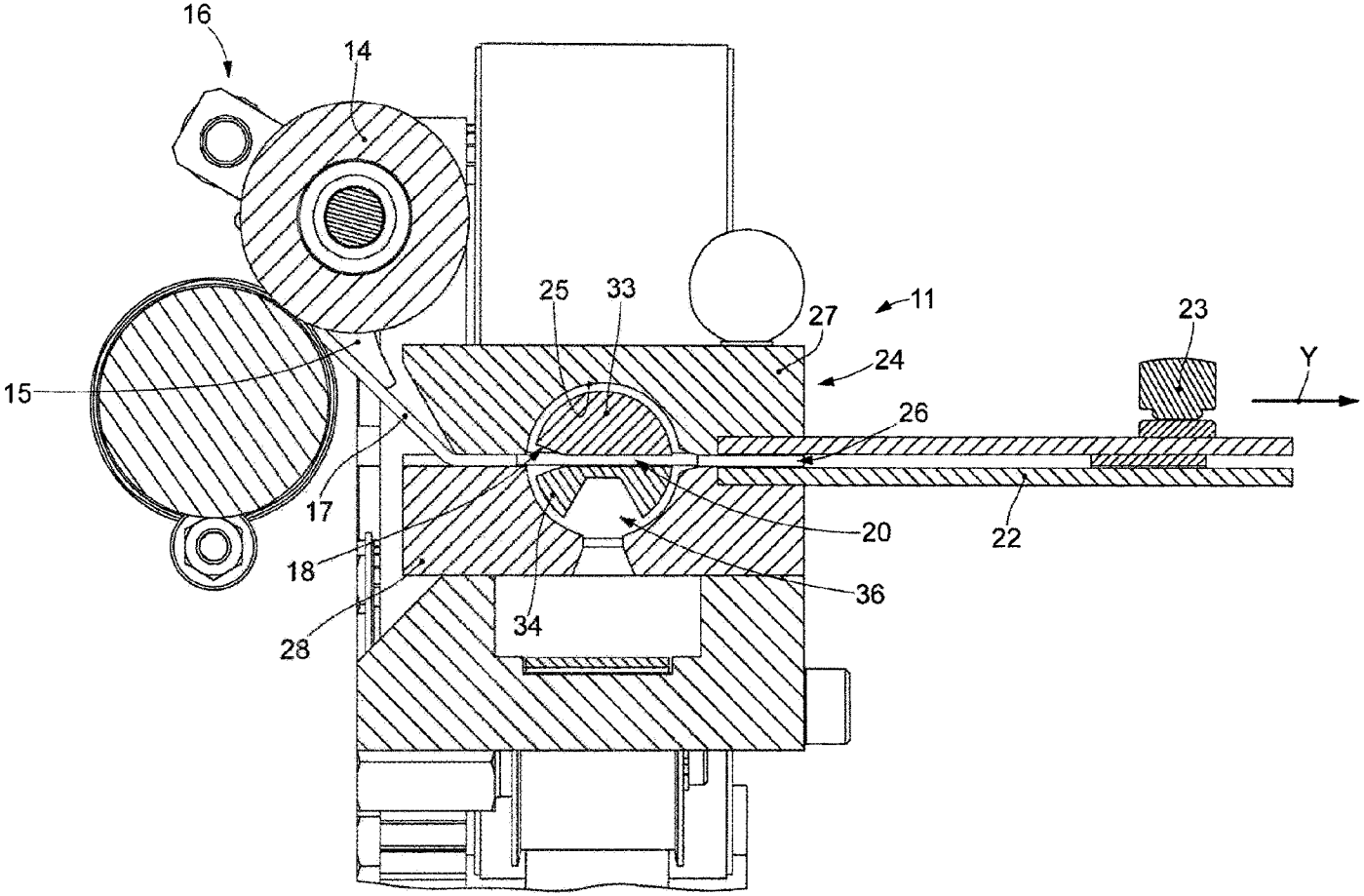
FIG. 2 is a cross-section respect to axis X of FIG. 1 of a folding apparatus according to the present invention.

Merely by way of example, with reference to FIG. 2, the folding apparatus 10 cooperates with entrance rollers 14 and with a possible entrance guide 15. The entrance rollers 14 can be part of the sheet feeding unit 16, located upstream of the conditioning unit 11, or part of another unit, or even part of the folding apparatus 10.

The entrance guide 15 can be made directly in the front part of the conditioning unit 11, or it can be a real and proper guide that takes at least one sheet 17 and delivers it to the conditioning unit 11.

In the example, the conditioning unit 11 has, advantageously, at least a bevel 18 on at least one upper part and/or at least also on one lower part of the entrance of the conditioning unit 11 in order to facilitate the autonomous insertion of the sheet 17.

The conditioning unit 11 also comprises, in the rear part, at least a housing guide 22 cooperating with at least a limitation body 23.

The limitation body 23 is advantageously adjustable in the housing guide 22 depending on the format of the sheet 17 that has to be folded.

The conditioning unit 11 comprises a containing body 24 and a cantilevered winding shaft 19. The conditioning unit 11 has a feeding slit 26 in operating continuity with a winding slit 20 associated with the winding shaft 19 in which the sheet 17 is positioned before the winding step in the shape of a tubular element 21.

In the cantilevered end part, the winding shaft 19 provides a conical conformation, in order to facilitate the extraction of the tubular element 21.

It should be noted that the positioning of the sheet 17 in the housing guide 22 provides that one portion of the sheet 17 also extends into the entrance part of the winding slit 20 in order to guarantee, when the winding shaft 19 is in the start step, that the sheet 17 does not exit.

The containing body 24 is advantageously hollow, for example a hollow ovoid shape, to define a conditioning seating 25 that contains the winding shaft 19.

The size of the conditioning seating 25 and the equivalent diameter of the winding shaft 19 are conditioned by a suitable ratio that determines the characteristics of the winding shaft 19 in relation to the physical characteristics of the sheet 17.

The containing body 24 has the feeding slit 26 through at least longitudinally to the direction of insertion of the sheet 17 to define an entrance and an exit.

The feeding slit 26 is operatively coordinated with the winding slit 20 and advantageously extends along at least the whole useful length of the containing body 24 so as to house sheets 17 of variable widths.

According to the present invention, the feeding slit 26 separates at least the containing body 24 into at least one upper element 27 and at least one lower element 28.

The upper element 27 can be opened to be able to intervene in the case of blockages of the sheets 17.

According to a variant, the upper element 27 and the lower element 28 can be positioned with respect to each other in a direction orthogonal to the plane of the sheet 17, in a controlled manner with suitable movement means 29.

Figure 3A:
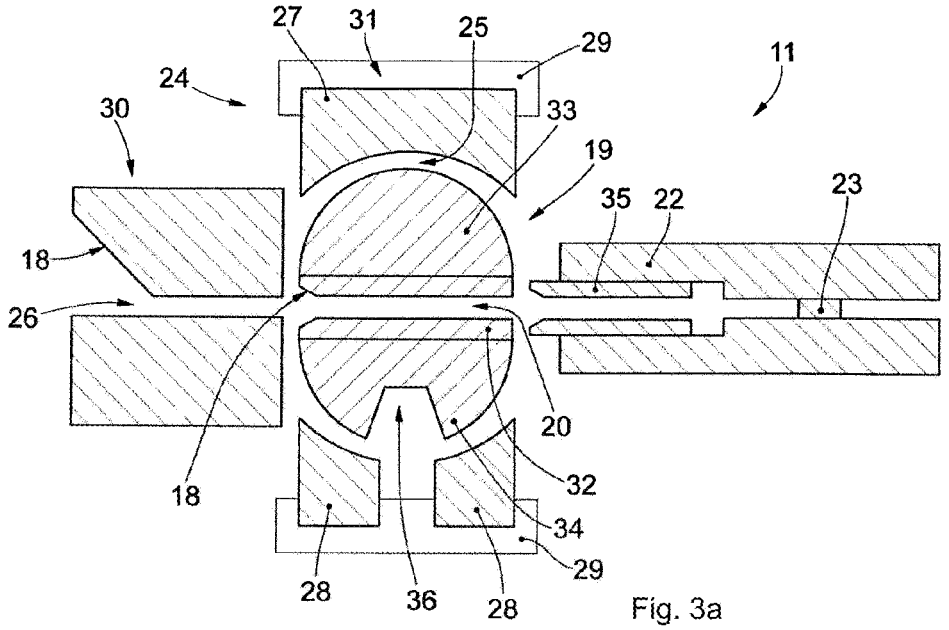
FIGS. 3*a* and 3*b* are two cross-sections respect to axis X of FIG. 1 of two example embodiments of a folding apparatus according to the present invention.
Figure 3B:
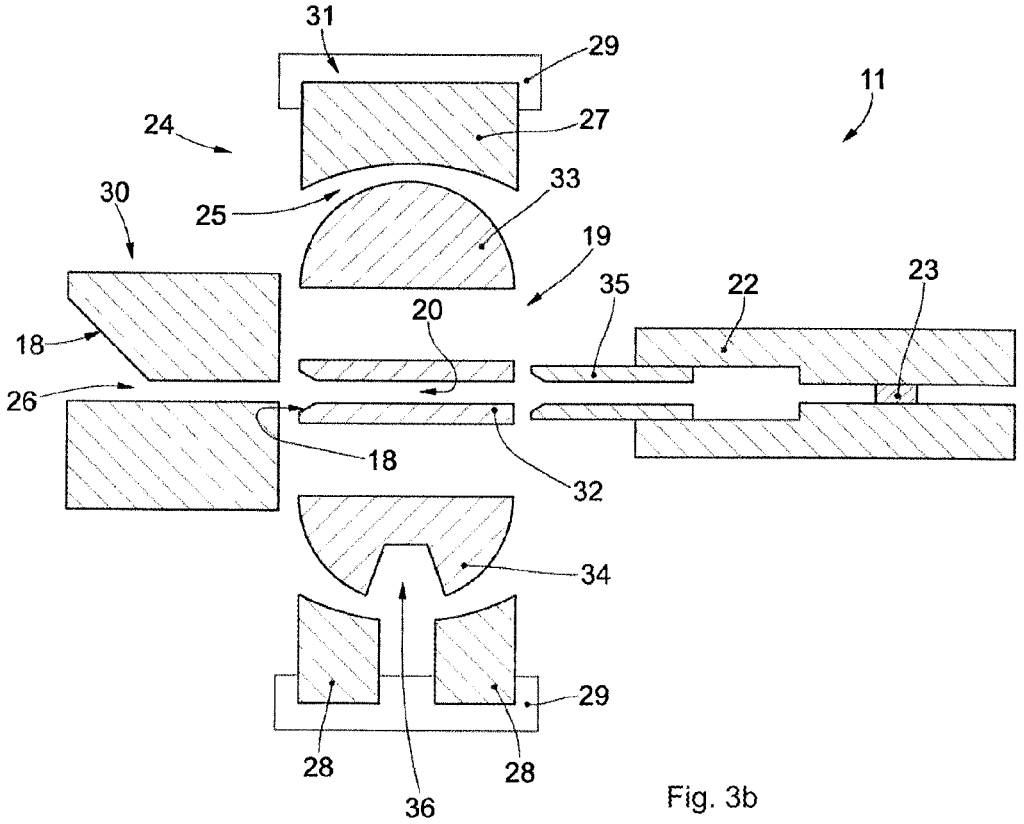

According to a variant in FIGS. 3*a* and 3*b*, the containing body 24 comprises a substantially fixed front body 30 and an adjustable rear body 31. The rear body 31 has two elements 27 and 28 positionable with respect to each other between which the winding shaft 19 is present.

In the case of this example variant, the winding shaft 19 has a guide 32 defining the fixed winding slit 20, at least during the introduction step of the sheet.

The upper component 33 and lower component 34 of the winding shaft 19 can be positioned to vary the equivalent diameter of the tubular element 21.

The positioning of the elements 33 and 34, by way of example, can be obtained by known means, such as pantograph, screws, calibration rings, etc.

In the example in FIG. 3, the containing unit 24 provides an insertion mean 35, advantageously positionable in a controlled manner depending on the rigidity of the sheet 17.

The insertion mean 35 allows to facilitate the insertion of the sheet 17 in the housing guide 22 avoiding blockages.

Moreover, the winding shaft 19 advantageously has a longitudinal seating 36 that extends as far as and including the cantilevered part.

The longitudinal seating 36 cooperates with the extraction mean 12 to facilitate and speed up the extraction of the tubular element 21.

In order to facilitate and simplify the replacement of the conditioning unit 11, according to the invention, a male-female connection 37 is provided with the motor member 38.

The male-female connection 37, by way of example, is conformed as a bayonette connection, that as well as transmitting the rotatory motion positions the winding shaft 19 quickly and univocally.

Thanks to this univocal positioning, the winding shaft 19 is already positioned with the winding slit 20 in axis with the feeding slit 26, facilitating the introduction of the sheet 17, which can transit correctly without glitches.

The rotation and the positioning of the winding shaft 19 and of its components (20, 33 and 34) can be totally or partly automated.

The extractor element 39, merely by way of non-restrictive example, can be in the shape of a tooth or other suitable shape to axially move the tubular element 21 without damaging it.

Moreover, the extractor element 39 is advantageously mobile on a movement guide 40, at least for the whole length of the winding slit 20 present in the winding shaft 19.

The extractor element 39 can be re-positioned, either doing the whole travel of the belt of the movement guide 40, or returning back.

Figure 4:
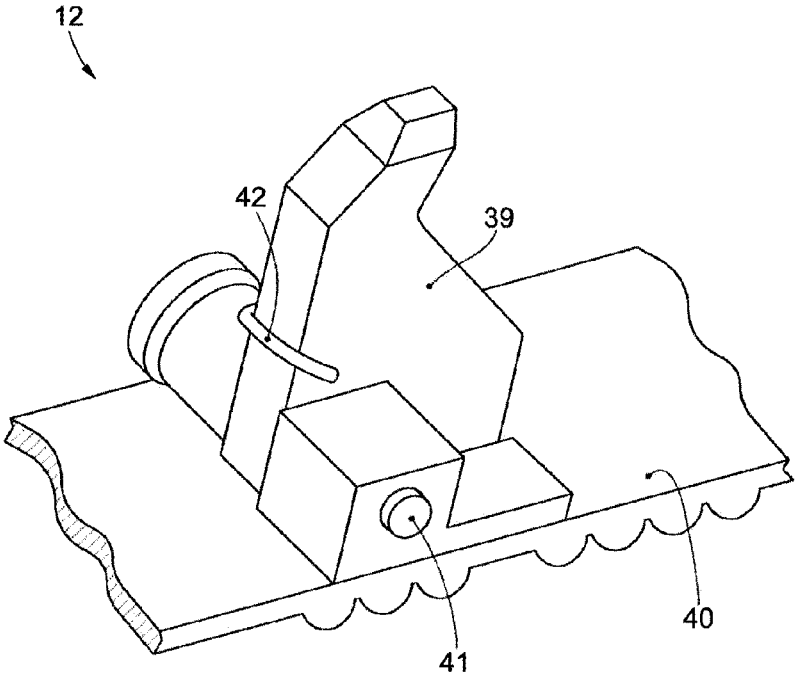
FIG. 4 is a perspective view of a detail of a component of the folding apparatus according to the present invention.

The extractor element 39, by way of example, has an oscillation pin 41 and is held in position by elastic means 42 (shown in FIG. 4), thanks to which, if a blockage occurs, it can bend without causing breakages.

The extractor element 39, advantageously, before ending its extraction travel, delivers the tubular element 21 to the folding unit 13.

The folding unit 13 comprises a compression mean 43 such as, for example, rollers and/or presses, including belts, or other similar or comparable means.

Moreover, the folding unit 13 can also provide transport guides 44 suitable to move the folded tubular elements 21 along a desired trajectory, advantageously adjustable.

According to one embodiment of the present invention, the method to fold a sheet 17 comprises:

- a step of positioning the folding apparatus 10, at least in the start-of-work step, and possible positioning of its components (23, 27-28, 33-34);
- a step of introducing the sheet 17 into the conditioning unit 11 until the limitation body 23 is reached so that a desired portion of the sheet 17 remains upstream of the winding shaft 19;
- a step of winding the sheet 17 on the winding shaft 19 to obtain a tubular element 21 inside the containing body 24;
- a step of extracting the tubular element 21 from the winding shaft 19 by an extractor element 39;
- a step of inserting the tubular element 21 into the folding unit 13;
- a step of compressing the tubular element 21 to obtain the folded sheet.

According to the present invention, the folding apparatus 10 also provides a repositioning step of the extractor element 39.

According to the present invention, the folding apparatus 10 described heretofore has a speed that can reach 350 single sheets per minute, advantageously a normal speed around 250 single sheets per minute.

It is clear that modifications and/or additions of parts may be made to the folding apparatus 10 and corresponding method as described heretofore, without departing from the field and scope of the present invention.

It is also clear that, although the present invention has been described with reference to some specific examples, a person of skill in the art shall certainly be able to achieve many other equivalent forms of folding apparatus and corresponding method, having the characteristics as set forth in the claims and hence all coming within the field of protection defined thereby.

The invention claimed is:

1. A folding apparatus for sheets, the apparatus comprising: at least a conditioning unit, at least an extractor element cooperating with a winding shaft and moveable along a longitudinal axis of said conditioning unit, and at least a folding unit cooperating with said conditioning unit, said conditioning unit being coupled to a sheet feeding unit which feeds a sheet to the conditioning unit, wherein said conditioning unit comprises a containing body and a housing guide associated with a limiting body.

2. The apparatus as in claim 1, wherein said containing body has a conditioning seating that houses the winding shaft in a cantilevered manner.

3. The apparatus as in claim 2, wherein said containing body and said winding shaft can be substituted and positioned in a defined manner.

4. The apparatus as in claim 2, wherein a diameter of said winding shaft and/or of said conditioning seating is variable.

5. The apparatus as in claim 2, wherein said containing body has a longitudinal slit in axis with a direction of the feed of the sheet, said longitudinal slit consisting of a feeding slit present in said containing body and of a winding slit present in said winding shaft and the feeding slit and the winding slit being coordinated operatively with each other and with said housing guide, wherein said feeding slit divides said containing body into two elements, upper and lower, which can be positioned with respect to each other.

6. The apparatus as in claim 1, wherein said containing body cooperates with its own introduction means and/or is associated with said sheet feeding unit.

7. The apparatus as in claim 1, wherein said folding unit has crushing means with a roll and/or a belt.

8. The apparatus as in claim 1, wherein the containing body has at least an upper element that can be opened.

9. The apparatus as in claim 1, wherein said winding shaft is housed cantilevered within a conditioning seating.

10. The apparatus as in claim 1, wherein said winding shaft comprises a winding slit configured to receive the sheet from the sheet feeding unit and extending along the longitudinal axis.

11. The apparatus as in claim 10, wherein said containing body comprises a feeding slit extending along the longitudinal axis and configured to cooperate with the winding slit in order to allow the sheet to pass through both the feeding slit and the winding slit when the sheet is fed to the conditioning unit by the feeding unit.

12. The apparatus as in claim 11, wherein said feeding slit divides said containing body into upper and lower elements divided by the feeding slit.

13. The apparatus as in claim 12, wherein the upper element and/or the lower element of the containing body can be opened.

14. The apparatus as in claim 1, wherein said conditioning unit comprises the housing guide associated to the conditioning unit and is configured to receive the sheet from the sheet feeding unit, and the limiting body which is adjustable along the housing guide depending on the size of the sheet.

15. The apparatus as in claim 1, wherein said extractor element comprises an oscillation pin associated with an elastic anti-jamming element.

16. The apparatus as in claim 1, wherein said winding shaft has a longitudinal seating that extends along the longitudinal axis and is configured to cooperate with the extractor element for removal of the sheet from the winding shaft.

17. A method to fold sheets by using a folding apparatus, said method comprising:

providing a folding apparatus for sheets, the folding apparatus comprising a conditioning unit, an extractor element cooperating with a winding shaft and moveable along a longitudinal axis of said conditioning unit, and a folding unit cooperating with said conditioning unit, said conditioning unit being coupled to a sheet feeding unit which feeds sheets to the conditioning unit, wherein said conditioning unit comprises a containing body and a housing guide associated with a limiting body; and a step of introducing at least a sheet into the conditioning unit, a step of winding said sheet inside the containing body of said conditioning unit to create a tubular element, a step of extracting said tubular element by an extractor mean from said containing body, a step of inserting said tubular element into the folding unit, a step of compressing said tubular element to obtain a folded sheet, and wherein said step of introducing provides that said sheet reaches a limiting body associated with the housing guide of said conditioning unit.

18. The method as in claim 17, comprising at least a step of repositioning said extractor mean.

19. The method as in claim 17, comprising at least a step of positioning a winding shaft and a conditioning seating able to define a desired equivalent diameter, being said winding shaft and said conditioning seating comprised in said containing body.

20. The method as in claim 17, which obtains a maximum operating speed of 350 individual sheets a minute, advantageously a normal operating speed of 250 individual sheets a minute.

21. A folding apparatus for sheets comprising a conditioning unit comprising a rotating winding shaft extended along a longitudinal axis and configured to wind a sheet around the outer surface of the winding shaft as the winding shaft is rotated in order to prepare the sheet to be folded, an extractor element movable along cooperating with the winding shaft and the longitudinal axis in order to remove the wound sheet from the winding shaft while keeping the winding shaft stationary, and at least a folding unit configured to fold the sheet, said conditioning unit being associated with a sheet feeding unit which feeds sheets to the conditioning unit, wherein said conditioning unit comprising a containing body which has a conditioning seating extending along the longitudinal axis and configured to house the winding shaft.

* * * * *